US009884218B2

(12) United States Patent
Harguth et al.

(10) Patent No.: US 9,884,218 B2
(45) Date of Patent: Feb. 6, 2018

(54) RETRACTABLE JUMP ROPE

(71) Applicant: The Prophet Corporation, Owatonna, MN (US)

(72) Inventors: Alison Marie Harguth, Owatonna, MN (US); Jason J. Ness, Victoria, MN (US); Caleb Summers, St. Louis Park, MN (US)

(73) Assignee: THE PROPHET CORPORATION, Owtonna, MN (US)

( * ) Notice: Subject to any disclaimer, the term of this patent is extended or adjusted under 35 U.S.C. 154(b) by 0 days.

(21) Appl. No.: 14/971,662

(22) Filed: Dec. 16, 2015

(65) Prior Publication Data

US 2017/0151457 A1 Jun. 1, 2017

Related U.S. Application Data

(60) Provisional application No. 62/261,641, filed on Dec. 1, 2015.

(51) Int. Cl.
*A63B 5/20* (2006.01)

(52) U.S. Cl.
CPC ..... *A63B 5/20* (2013.01); *A63B 2210/50* (2013.01)

(58) Field of Classification Search
CPC ... A63B 21/153; A63B 21/154; A63B 21/155; A63B 21/156; A63B 5/20; A63B 5/205; A01K 27/004
See application file for complete search history.

(56) References Cited

U.S. PATENT DOCUMENTS

| | | | | |
|---|---|---|---|---|
| 498,753 | A | 5/1893 | Tuoker | |
| 633,590 | A | 9/1899 | Hinkson | |
| 674,431 | A | 5/1901 | Black | |
| 1,436,703 | A | 11/1922 | Fisher | |
| 1,462,088 | A * | 7/1923 | La Sares | A63B 5/20 16/430 |
| 1,584,122 | A | 5/1926 | Moore | |
| 1,629,209 | A | 5/1927 | Fairbanks | |
| 3,140,871 | A | 7/1964 | Liguori | |
| 3,475,023 | A | 10/1969 | Fauvelle | |
| 4,179,119 | A | 12/1979 | Wolf | |
| 4,293,125 | A | 10/1981 | Hinds | |
| D263,326 | S | 3/1982 | Cooper | |
| 4,776,585 | A | 10/1988 | Maleyko | |
| 5,138,585 | A | 8/1992 | Aragon, Jr. | |
| 5,190,508 | A | 3/1993 | Kliewer et al. | |
| D339,180 | S | 9/1993 | Taylor | |

(Continued)

OTHER PUBLICATIONS

Gopher Sport, [online], [site visited Dec. 19, 2016], Available from Internet, <URL: http ://gophersport.com/fitness/introductory-jump-ropes/retract-a-rope-adjustable-jump-rope>.

(Continued)

*Primary Examiner* — Loan H Thanh
*Assistant Examiner* — Rae Fischer
(74) *Attorney, Agent, or Firm* — Merchant & Gould P.C.

(57) ABSTRACT

A jump rope includes an elongated flexible member (e.g., a rope) that extends between two handle arrangements. The elongated flexible member can be stored within the handle arrangements. For example, each handle arrangement can hold a spool on which a portion of the flexible member can be wound. The portions of the flexible member can be automatically retracted within the handles.

19 Claims, 9 Drawing Sheets

(56) References Cited

U.S. PATENT DOCUMENTS

| | | | | |
|---|---|---|---|---|
| 5,377,626 | A * | 1/1995 | Kilsby | A01K 27/004 119/796 |
| 5,697,871 | A | 12/1997 | Landfair | |
| D402,717 | S | 12/1998 | Stark | |
| D407,450 | S | 3/1999 | Janet | |
| 5,961,425 | A | 10/1999 | Reid et al. | |
| D452,891 | S | 1/2002 | Barr | |
| 7,037,243 | B1 | 5/2006 | Clancy | |
| 7,361,074 | B1 | 4/2008 | Periman et al. | |
| 7,967,737 | B2 * | 6/2011 | Watson | A63B 5/20 482/139 |
| D691,219 | S | 10/2013 | Kessler | |
| 8,911,333 | B2 | 12/2014 | Hunt | |
| D728,711 | S | 5/2015 | Taylor | |
| 9,056,216 | B1 | 6/2015 | Bouza | |
| 9,254,401 | B2 | 2/2016 | Rogers et al. | |
| 2004/0218383 | A1 | 11/2004 | Bailey, III | |
| 2006/0052221 | A1 | 3/2006 | Cohen | |
| 2010/0160116 | A1 | 6/2010 | LaTour | |
| 2011/0306474 | A1 | 12/2011 | Gamboa | |

OTHER PUBLICATIONS

U.S. Design Application No. 29/547,133, filed Dec. 1, 2015, and titled "Jump Rope and Handle Thereof" (Attorney Docket No. 07590.0127US01).

* cited by examiner

RETRACTABLE JUMP ROPE

CROSS REFERENCE TO RELATED APPLICATION

This application claims the benefit of U.S. Provisional Application No. 62/261,641, filed Dec. 1, 2015, and titled "Retractable Jump Rope," the disclosure of which is hereby incorporated herein by reference.

BACKGROUND

Jump ropes are used for many fitness and training purposes. Jump ropes also can be used for play. A standard jump rope includes a rope extending between two handles. Conventionally, a user grasps the handles and swings the rope over the user's head. When the rope reaches the nadir of the swing, the user jumps over the rope. Jump ropes can be difficult to store. The rope of the jump ropes can become tangled between uses if not stored properly. Storing multiple jump ropes together can exacerbate this problem.

Improvements are desired.

SUMMARY

Some aspects of the disclosure are directed to a jump rope including an elongated flexible member; a first storage chamber housing defining a first port through which the elongated flexible member extends so that the first end of the elongated flexible member is secured within an interior of the first storage chamber housing; a first handlebar extending outwardly from the first storage chamber housing; a second storage chamber housing defining a second port through which the elongated flexible member extends so that the second end of the elongated flexible member is secured within an interior of the second storage chamber housing; and a second handlebar extending outwardly from the second storage chamber housing. In certain implementations, each storage chamber holds a spool, a retraction member, and a hold member within the interior of the storage chamber housing. Each retraction member is configured to automatically wind at least a portion of the elongated flexible member on the respective spool. Each hold member is configured to selectively inhibit the automatic winding by the respective retraction member.

In certain implementations, the elongated flexible member extends through the first port of the first storage chamber housing without passing through the first handlebar.

In certain implementations, a stop member is disposed at a fixed location on the elongated flexible member. The stop member is sized larger than the first and second ports. In certain examples, the stop member separates the elongated flexible member into a first length and a second length. The interior of the first storage chamber housing is sized to hold the first length and the interior of the second storage chamber housing is sized to hold the second length. In an example, the first length is the same as the second length.

In certain implementations, the first storage chamber housing includes a first release member accessible from an exterior of the first storage chamber housing. The first release member is configured to move the first hold member from a respective hold position to a respective release position, thereby allowing the first retraction member to wind at least some of the first portion of the elongated flexible member on the first spool.

In certain implementations, the second storage chamber housing includes a second release member. The second release member is configured to move the second hold member from a respective hold position to a respective release position, thereby allowing the second retraction member to wind at least some of the second portion of the elongated flexible member on the second spool.

In certain implementations, the first retraction member includes a spring. The first hold member includes a ratchet pawl biased towards ratchet teeth defined by the first storage chamber housing. The first release member is operationally coupled to the first hold member so that actuation of the first release member will disengage the ratchet pawl from the ratchet teeth.

In certain implementations, the first handlebar defines a longitudinal axis and the first spool defines a rotational axis that is not coaxially with the longitudinal axis. In examples, the longitudinal axis of the first handlebar is transverse to the rotational axis of the first spool.

In some implementations, the elongated flexible member includes a braided rope. In other implementations, the elongated flexible member includes a solid rope.

Other aspects of the disclosure are directed to a jump rope including an elongated flexible member; a stop member disposed on the elongated flexible member at an intermediate location; a first handle arrangement defining a first storage chamber sized to store a first length of the elongated flexible member; and a second handle arrangement defining a second storage chamber sized to store a second length of the elongated flexible member. In certain implementations, the first handle arrangement defines a port through which the first length is dispensed from and retracted into the first storage chamber. The first handle arrangement also includes a first handlebar extending outwardly from the first storage chamber opposite from the respective port. The second handle arrangement defines a port through which the second length is dispensed from and retracted into the second storage chamber. The second handle arrangement also includes a second handlebar extending outwardly from the second storage chamber opposite from the respective port.

In certain examples, the elongated flexible member has a uniform diameter over a full length of the elongated flexible member. In certain examples, the elongated flexible member has a smaller diameter than that of a conventional jump rope. Accordingly, in such examples, the elongated flexible member weighs less than a conventional jump rope. In examples, the stop member provides additional weight to the elongated flexible member to enhance the ability to swing the elongated flexible member.

In certain implementations, the elongated flexible member includes a first elongated flexible member and a second elongated flexible member that are both fixedly coupled to the stop member to form the elongated flexible member.

In certain implementations, the first handle arrangement includes an automatic retraction mechanism configured to automatically wind the first length of the elongated flexible member. In certain examples, the automatic retraction mechanism is actuated by movement of a release member disposed on the first handle arrangement.

In examples, the automatic retraction mechanism includes a spool biased to rotate in a first rotational direction and a blocking pawl configured to move between blocking and releasing positions. The blocking pawl retains the spool against rotating in the first rotational direction when in the blocking position. The blocking pawl releases the spool to rotate in the first rotational direction when in the releasing position. In an example, the block pawl is moved between the blocking position and the release position by sliding the release member. In an example, the block pawl is moved between the blocking position and the release position by depressing the release member.

In some implementations, the elongated flexible member includes a braided rope. In other implementations, the elongated flexible member includes a solid rope.

Other aspects of the disclosure are directed to a method of exercising. The method includes grasping a first handle arrangement with a first hand of a user and a second handle arrangement in a second hand of the user, the elongated member joining the first and second handle arrangements; stepping on a stop member disposed on the flexible elongated member; pulling the first and second handle arrangements away from the stop member to increase the length of the elongated member extending between the first and second handle arrangements; and swinging the flexible, elongated member using the first and second handlebar arrangements.

In certain implementations, the method also includes moving a release member relative to the first handle arrangement to begin retraction of the flexible elongated member within a storage chamber of the first handle arrangement.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Reference will now be made in detail to exemplary aspects of the present disclosure that are illustrated in the accompanying drawings. Wherever possible, the same reference numbers will be used throughout the drawings to refer to the same or like parts.

The present disclosure relates generally to a jump rope that facilitates storage. The jump rope includes an elongated flexible member (e.g., a rope) that extends between two handle arrangements. The elongated flexible member can be stored within the handle arrangements. For example, at least one of the handle arrangements can include a storage chamber in which the elongated flexible member can be wound and from which the elongated flexible member can be dispensed. In certain examples, a first length of the elongated flexible member is wound within and dispensed from a first handle arrangement and a second length of the elongated flexible member is wound within and dispensed from a second handle arrangement.

Figure 1:
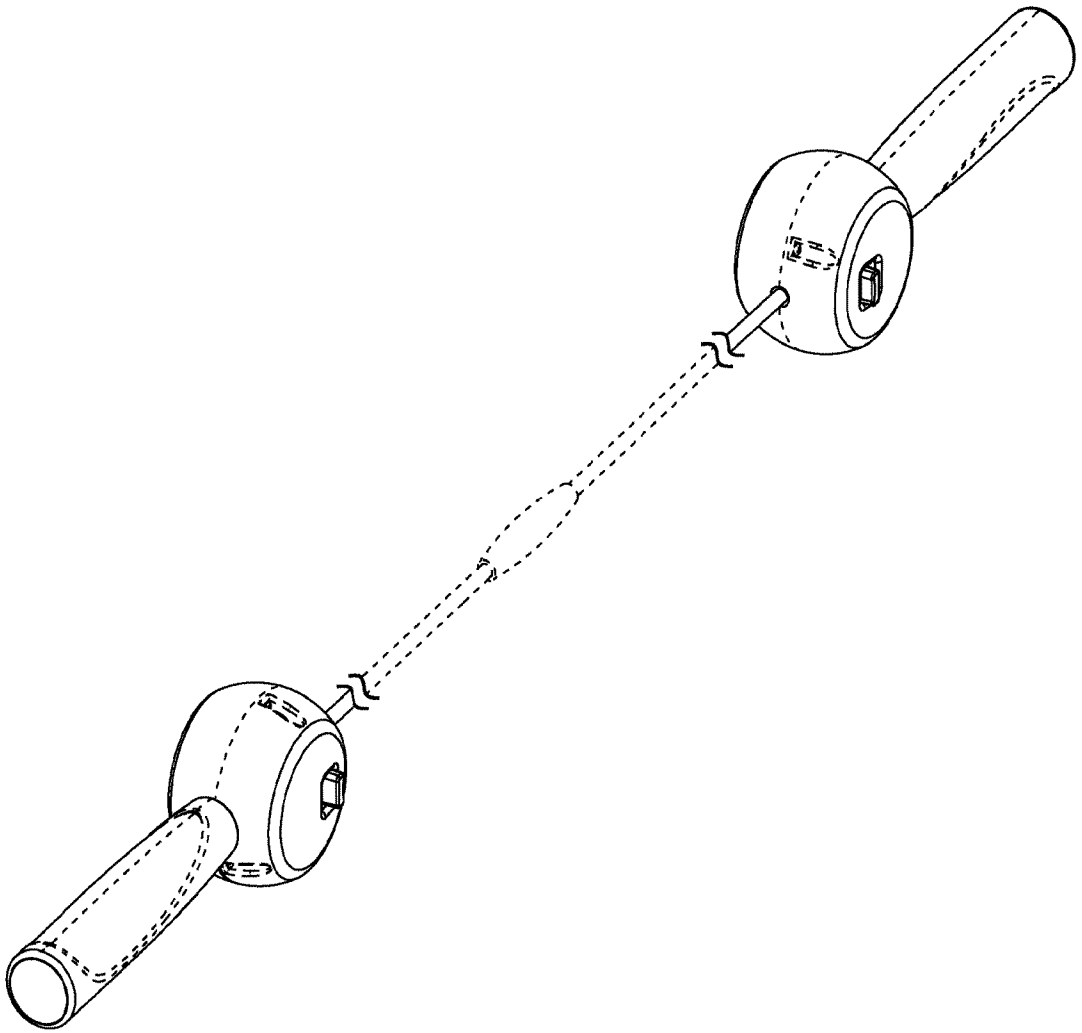
FIG. 1 is a perspective view of a jump rope.

FIG. 1 illustrates an example jump rope 100 that includes an elongated flexible member 102 coupled to a first handle arrangement 110A and a second handle arrangement 110B. The jump rope 100 can be transitioned between a storage configuration and a use configuration. When in the use configuration, a usable portion of the elongated flexible member 102 extends between the first and second handle arrangements 110A, 110B. When in the storage configuration, at least part of the usable portion of the elongated flexible member 102 is contained within one or both of the handle arrangements 110A, 110B. In certain implementations, at least a majority of the usable portion of the elongated flexible member 102 is contained within one or both of the handle arrangements 110A, 110B.

To use the jump rope 100, a user grasps the first handle arrangement 110A in a first hand and the second handle arrangement 110B in a second hand while the jump rope 100 is arranged in the storage configuration. The user pulls the first and second handle arrangements 110A, 110B away from each other to deploy the elongated flexible member 102 therebetween, thereby transitioning the jump rope 100 to the use configuration. The user can then use the jump rope 100 to exercise or play. When finished, the user can trigger a retraction mechanism at one or both handle arrangements 110A, 110B to retract at least part of the usable portion of the elongated member 102 therein for storage.

Figure 2:
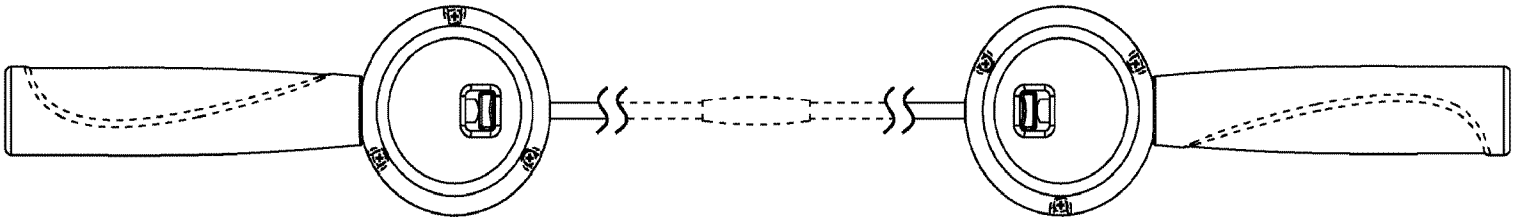
FIG. 2 is a first side view of thejump rope of FIG. 1.
Figure 3:
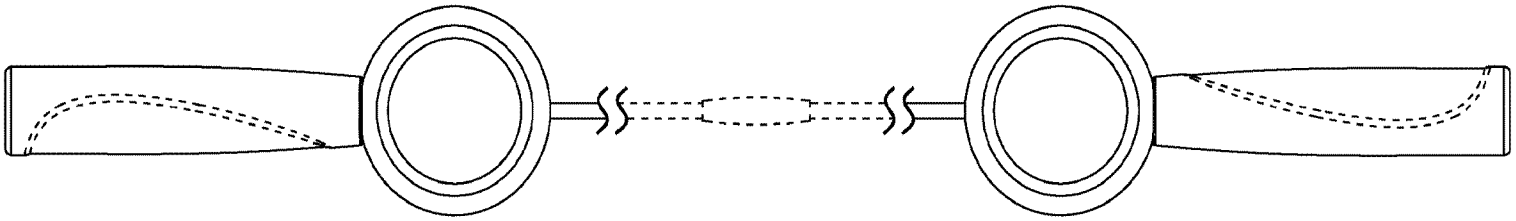
FIG. 3 is an opposite second side view of the jump rope of FIG. 1.
Figure 4:
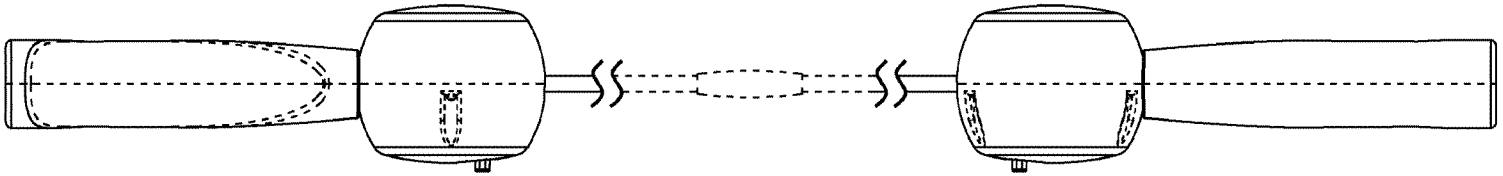
FIG. 4 is a top plan view of thejump rope of FIG. 1.

As shown in FIG. 2, the elongated flexible member 102 extends from a first end 103 to a second end 104. In certain examples, the elongated flexible member 102 has a uniform diameter over a length of the elongated flexible member 102. The first end 103 is secured to the first handle arrangement 110A and the second end 104 is secured to the second handle arrangement 110B. In some implementations, the elongated flexible member 102 includes a solid rope. For example, the elongated flexible member 102 can include a solid PVC cord. In other implementations, the elongated flexible member 102 includes a braided rope (e.g., diamond braided). For example, the elongated flexible member 102 can include a braided-nylon cord, a braided polypropylene rope, a cotton rope, or a polyester rope. In certain examples, plastic segments can be disposed over the elongated flexible member 102.

In some implementations, a stop 105 is disposed on the elongated flexible member 102. The stop 105 is axially fixed along a length L of the elongated flexible member 102. Accordingly, the stop 105 divides the elongated flexible member 102 into a first section 106, which extends between the first end 103 and the stop 105, and a second section 107, which extends between the stop 105 and the second end 104. In an example, the stop 105 can be generally spherical shaped. In another example, the stop 105 can have an elongated bead shape.

In accordance with some aspects of the disclosure, at least one of the handle arrangements 110A, 110B is configured to contain at least a portion of the elongated flexible member 102. In certain examples, enough of the elongated flexible member 102 can be stored in one or both handle arrangements 110A, 110B so that the handle arrangements 110A, 110B contact each other. In certain examples, enough of the elongated flexible member 102 can be stored in one or both handle arrangements 110A, 110B so that both handle arrangements 110A, 110B contact the stop member 105. In certain examples, the first handle arrangement 110A contains at least part of the first section 106 of the elongated member 102 and the second handle arrangement 110B contains at least part of the second section 107 of the elongated member 102.

In some implementations, the elongated flexible member 102 has an outer diameter that is smaller than an outer diameter of a rope of a traditional jump rope. The smaller diameter allows a greater length of the elongated member 102 to be disposed within the handle arrangement(s) 110A, 110B than would otherwise be possible with a traditional rope. Accordingly, in some implementations, a spool 114 in one handle arrangement 110A, 110B can hold substantially the entire length of the elongated member 102. In other implementations, spools 114 in both handle arrangements 110A, 110B can cooperate to hold substantially the entire length of the elongated member 102 (e.g., the length minus the stop member 105).

In some implementations, the outer diameter of the flexible meme 102 is no more than 0.5 inches. In certain implementations, the outer diameter of the flexible meme 102 is no more than 0.3 inches. In certain implementations, the outer diameter of the flexible meme 102 is no more than 0.2 inches. In certain implementations, the outer diameter of the flexible meme 102 is no more than 0.15 inches. In certain implementations, the outer diameter of the flexible meme 102 is no more than 0.1 inches.

In some cases, the smaller outer diameter of the elongated member 102 yields a lighter elongated member 102 than in traditional jump ropes. For example, in certain implementations, the elongated member 102 may weight no more than about 18 grams. In certain implementations, the elongated member 102 may weight no more than about 20 grams. In certain implementations, the elongated member 102 may weight no more than about 18 grams. In certain implementations, the elongated member 102 may weight no more than about 16 grams. In certain implementations, the elongated member 102 may weight no more than about 15 grams. In an example, the elongated member 102 is about 14.8 grams.

If the elongated member 102 is too light, then the elongated member 102 will not swing properly. Accordingly, in certain implementations, the stop member 105 is manufactured with a weight that is sufficient to enable or enhance swinging of the elongated member 102. For example, in certain implementations, the stop member 105 has a weight of at least about 10 grams. In certain implementations, the stop member 105 has a weight of at least about 12 grams. In certain implementations, the stop member 105 has a weight of at least about 14 grams. In certain implementations, the stop member 105 has a weight of at least about 16 grams. In certain implementations, the stop member 105 has a weight of at least about 18 grams. In certain implementations, the stop member 105 has a weight of at least about 20 grams. In an example, the stop member 105 has a weight of about 16.3 grams.

FIGS. 3-8 illustrate an example handle arrangement 110 suitable for use as the handle arrangements 110A, 110B of FIG. 1. The handle arrangement 110 includes a storage chamber housing 111 in which a portion of the elongated flexible member 102 can be stored. The first end 103 of the elongated flexible member 102 is secured within an interior of the storage chamber housing 111. The storage chamber housing 111 defines a port 112 through which the elongated flexible member 102 extends. The elongated flexible member 102 passes through the port 112 when the elongated flexible member 102 enters and exits the storage chamber housing 111.

In certain implementations, the stop member 105 is sized larger than the first and second ports 112 so that the stop member 105 cannot enter the storage chamber housing 111. In certain examples, the interior of the storage chamber housing 111 of the first handle arrangement 110A is sized to hold the first section 106 of the elongated member 102 and the interior of the storage chamber housing 111 of the second handle arrangement 110B is sized to hold the second section 107. In an example, the stop 105 can be disposed at a central location along the length L of the elongated flexible member 102. In an example, a length of the first section 106 is approximately equal to a length of the second section 107.

The handle arrangement 110 also includes a handlebar 119 coupled to the storage chamber housing 111. In certain implementations, the handlebar 119 is elongated between a first end and a second end. In certain examples, the first end of the handlebar 119 contacts the storage chamber housing 111 opposite the port 112. The second end of the handlebar 119 extends away from the storage chamber housing 111. The handlebar 119 is sized to fit comfortably in the hand of a user. In certain examples, the handlebar 119 may define a textured section that aids the user in maintaining a grip on the handlebar 119.

Figure 8:
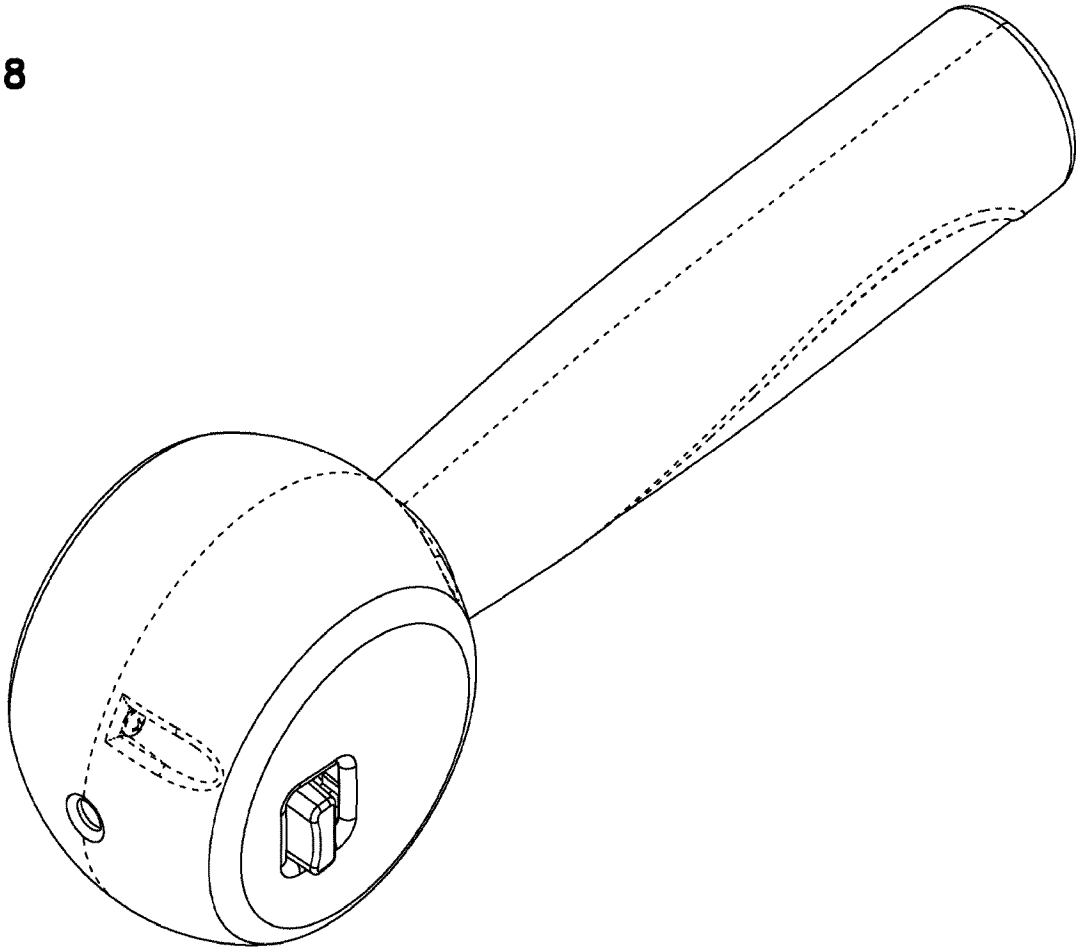
FIG. 8 is a perspective view of a jump rope handle.
Figure 9:
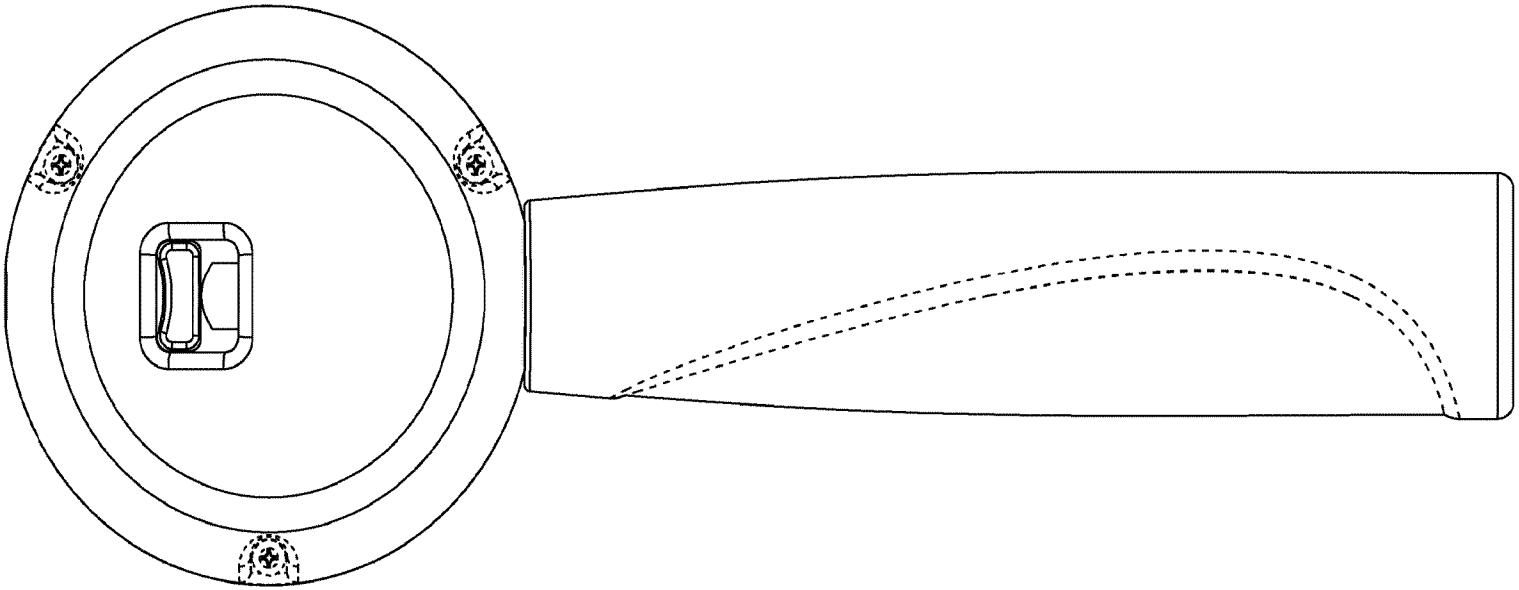
FIG. 9 is a first side view of the jump rope handle of FIG. 8.
Figure 10:
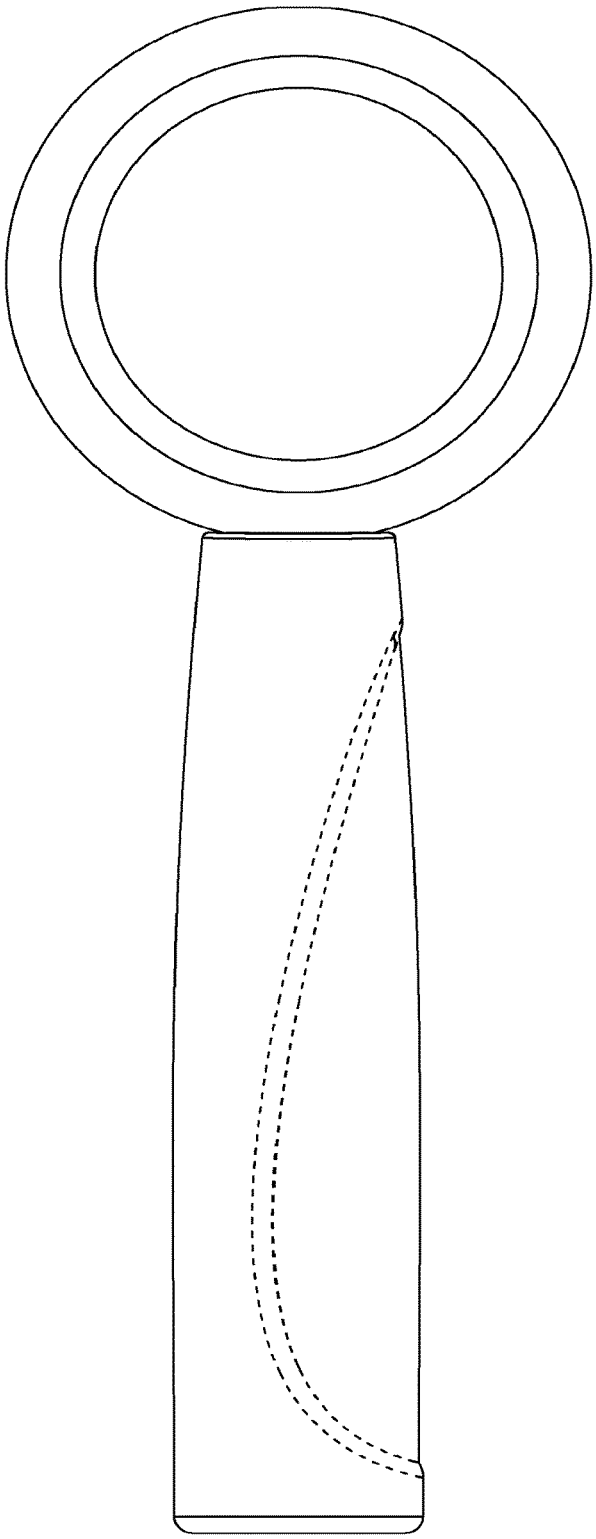
FIG. 10 is an opposite second side view of the jump rope handle of FIG. 8.
Figure 12:
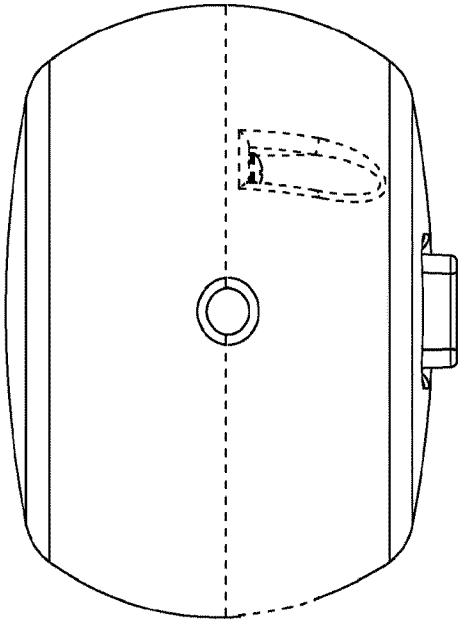
FIG. 12 is a bottom plan view of the jump rope handle of FIG. 8.
Figure 11:
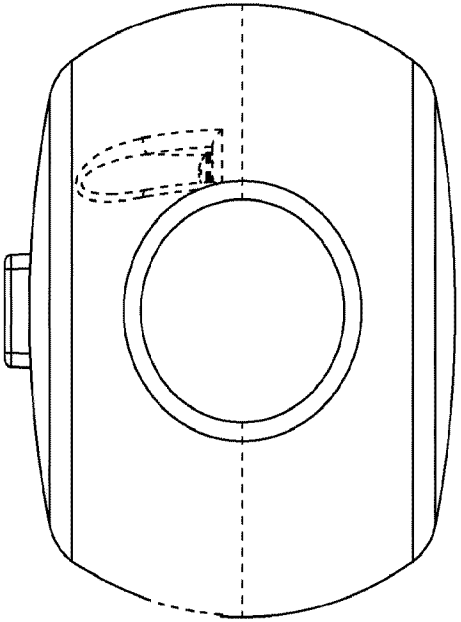
FIG. 11 is a top plan view of the jump rope handle of FIG. 8.
Figure 13:
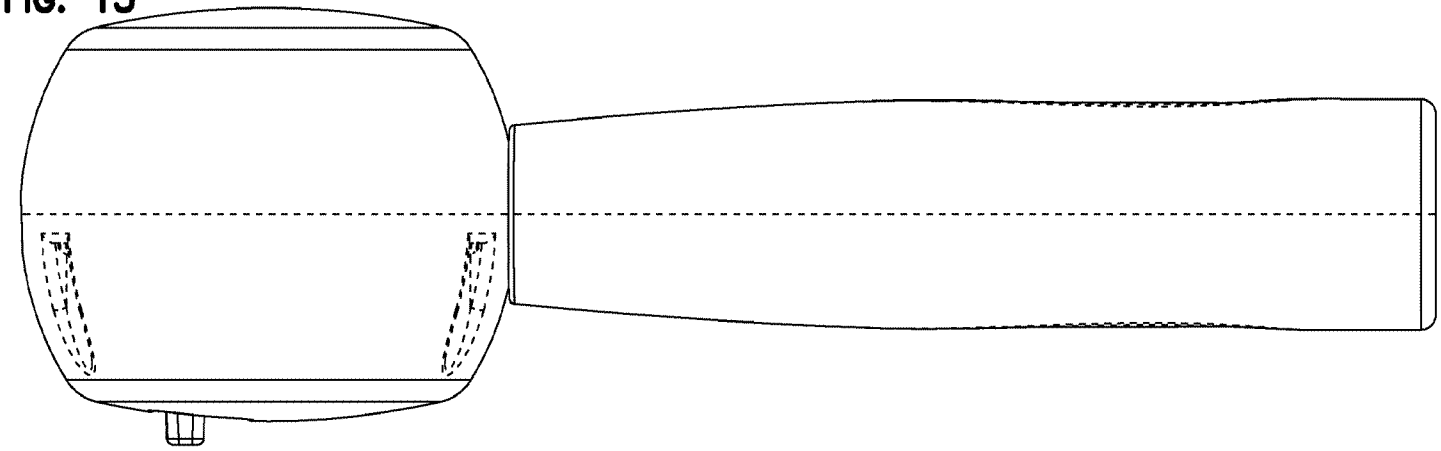
FIG. 13 is a first end view of the jump rope handle of FIG. 8.
Figure 14:
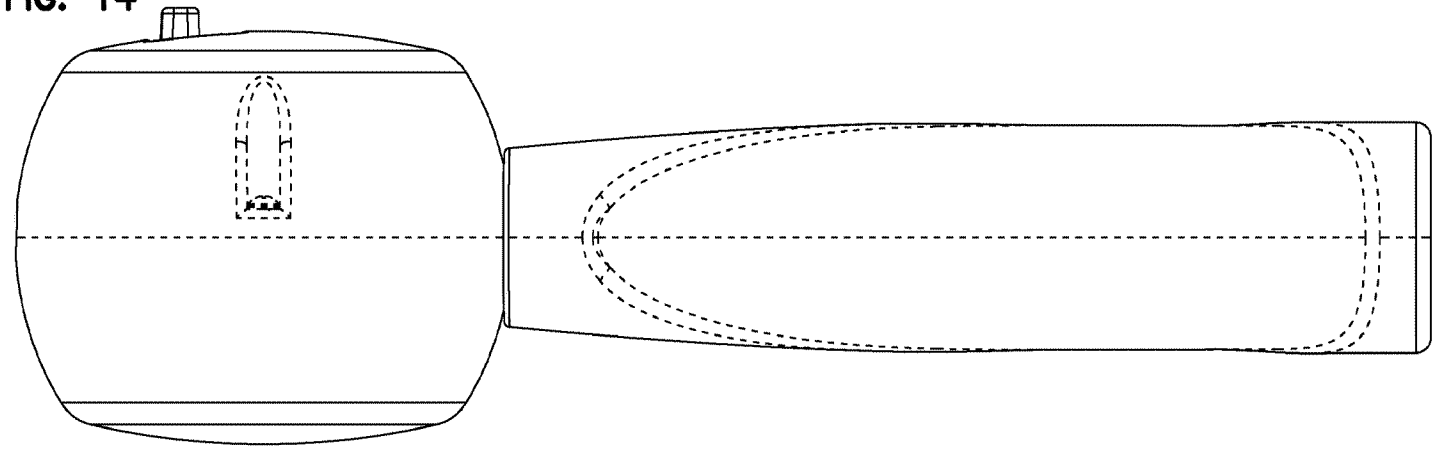
FIG. 14 is an opposite second end view of the jump rope handle of FIG. 8.

The storage chamber housing 111 holds a spool 114 on which the elongated flexible member 102 can be wound (e.g., see FIG. 8). In certain implementations, an interior of the storage chamber housing 111 is not open to an interior of the handlebar 119. Accordingly, the elongated flexible member 102 does not have access to the interior of the handlebar 119. Rather, in such implementations, any retracted portion of the elongated flexible member 102 is disposed within the storage chamber housing 111. Moreover, the elongated flexible member 102 extends through the port 112 without passing through the handlebar 119.

The end 103, 104 of the elongated flexible member 102 can be secured to the spool 114. Rotation of the spool 114 relative to the storage chamber housing 111 in a first rotational direction R1 causes the elongated flexible member 102 to wind onto the spool 114. Rotation of the spool 114 relative to the storage chamber housing 111 in an opposite, second rotational direction R2 causes the elongated flexible member 102 to unwind from the spool 114. Pulling the elongated flexible member 102 out of the storage chamber housing 111 through the port 112 causes rotation of the spool 114 in the second rotational direction R2. In certain implementations, the rotational axis of the spool 114 is not coaxially with a longitudinal axis of the handlebar 119. In certain examples, the rotational axis of the spool 114 is generally transverse with a longitudinal axis of the handlebar 119.

A retraction member 115 applies a rotation force on the spool 114 in the first rotational direction R1. Accordingly, the retraction member 115 is configured to automatically wind at least a first portion of the elongated flexible member 102 onto the spool 114. In certain implementations, the retraction member 115 includes a spring (e.g., a flat spring, a torsion spring, a coil spring, etc.). In certain implementations, the retraction member 115 is constantly applying the rotation force to the spool 114. In certain implementations, the retraction member 115 is disposed within the storage chamber housing 111. The retraction member 115 is operably coupled to the spool 114 to apply the rotation force. In certain examples, an end of the retraction member 115 is secured to the spool 114.

A hold member 116 is disposed within the interior of the storage chamber housing 111. The hold member 116 is configured to selectively inhibit the automatic winding of the elongated flexible member 102 onto the spool 114 by the retraction member 115. In certain examples, the hold member 116 is configured to counter the rotational force applied to the spool 14 by the retraction member 115 until released. In certain implementations, the hold member 116 forms part of a ratchet-and-pawl mechanism that limits rotation of the spool 114 in the first rotational direction R1. In certain examples, the hold member 116 does not limit rotation of the spool 114 in the second rotational direction R2. Rather, the spool 114 rotates in the second rotational direction, and dispenses the elongated flexible member 102, when the rotation force applied by the retraction member 115 is overcome.

A release member 118 is operationally coupled to the hold member 116 to move the hold member 116 between a hold position and a release position. When in the hold position, the hold member 116 counters the rotational force applied to the spool 14 by the retraction member 115. When in the release position, the hold member 116 does not counter the rotational force, thereby allowing the retraction member 115 to rotate the spool 114 in the first rotational direction R1. In certain implementations, the hold member 116 is biased towards the hold position until moved by the release member 118.

In certain implementations, the release member 118 is accessible from an exterior of the storage chamber housing 111. A user actuates the release member 118 to move the hold member 116 from the hold position to the release position. For example, the user can move the release member 118 from an unactuated position to an actuated position. In such an example, the release member 118 is biased towards the unactuated position unless acted upon by the user. In the example shown, the release member 118 includes a tab extending outwardly from the storage chamber housing and slidable relative to the storage chamber housing 111 as will be described in more detail herein.

Figure 5:
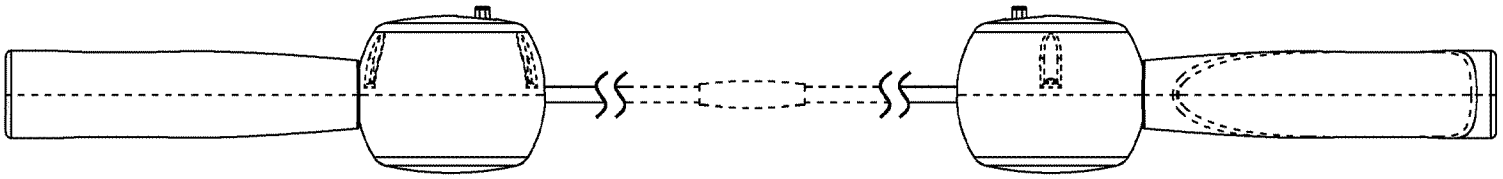
FIG. 5 is a bottom plan view of the jump rope of FIG. 1.

FIGS. 5-8 illustrate one example implementation of a spool 114, a retraction member 115, a hold member 116, and a release member 118. The spool 114 extends from a first axial end 130 to a second axial end 131. A drum 132 is defined between the two axial ends 130, 131. In the example shown in FIG. 6, the drum 132 defines a fixing aperture 133 at which one end of the elongated flexible member 102 can be attached to the spool 114. The first axial end 130 of the spool 114 defines an inwardly extending passage 134 (FIG. 6) and the second axial end 131 defines another inwardly extending passage 137 (FIG. 5). In an example, the inwardly extending passages 134, 137 may join together within the drum 132.

The storage chamber housing 111 includes a first housing member 120 and a second housing member 125. In certain implementations, the first and second housing members 120, 125 cooperate to define the port 112. The first housing member 120 defines an interior 121 in which a first spindle 123 is disposed (FIG. 5). The second housing member 125 defines an interior 126 in which a second spindle 128 is disposed. The first spindle 123 is sized to extend into the inwardly extending passage 134 at the first axial end 130 of the spool 114. The second spindle 128 is sized to extend into the inwardly extending passage 137 at the second axial end 131 of the spool 114. The spool 114 is configured to rotate relative to the housing members 120, 125 about the spindles 123, 128.

The first and second housing members 120, 125 cooperate to define the storage chamber housing 111. For example, the first and second housing members 120, 125 are positioned so that the interiors 121, 126 face each other. In some implementations, the first and second housing members 120, 125 are fastened together. For example, fasteners can be inserted through fastener openings 124, 129 to hold the first and second housing members 120, 125 together. In other implementations, the first and second housing members 120, 125 can be welded (e.g., sonically welded, heat welded, etc.), threaded, latched, or otherwise held together.

In certain implementations, the spool 114 defines a cavity 135 at the first axial end 130. The retraction member 115 can be disposed within the cavity 135 (see FIG. 8). In certain examples, a spool cover couples to the spool 114 to cover the cavity 135. In an example, the spool cover is rotationally keyed to the spool 114 so that the cover cannot rotate relative to the spool 114.

In some examples, the retraction member 115 attaches to the first spindle 123 (e.g., at a notch defined in the first spindle 123). For example, a flat spring may be coiled inside the cavity 135. An inner end of the flat spring may extend through the notch defined in the first spindle 123. The outer end of the flat spring may wrap around or otherwise attach to an outer perimeter of the cavity 135. Accordingly, rotation of the spool 114 in a first direction will cause the outer end of the flat spring to turn relative to the inner end, thereby tightening the coil. Rotational of the spool 114 in an opposite direction will loosen the coil and relax the spring.

In other implementations, the retraction member 115 extends out of the cavity 135 and attaches to the first housing member 120. In still other examples, the retraction member 115 is attached to a spool cover that closes the cavity 135 and secures to the housing 120.

Relative movement between the spool 114 and the housing member 120 stretches and relaxes the retraction member 115. For example, unwinding the flexible member from the spool 114 causes the spool 114 to rotate in a first direction, thereby moving one end of the retraction member 115 relative to another end of the retraction member 115 to stretch the retraction member 115. Stretching the retraction member 115 increases the tension of the retraction member 115, thereby applying a rotational bias to the spool 114 in the opposite direction. Rotating the spool 114 in the opposite direction causes the flexible member to be wound onto the spool 114.

The hold member 116 inhibits the spool 114 from rotating under the rotational bias. In certain implementations, the hold member 116 forms part of a ratcheting mechanism disposed at the second end 131 of the spool 114. The ratcheting mechanism includes ratchet teeth 139 and a spring-biased ratchet pawl 141. In some implementations, the ratchet teeth 139 are disposed on the spool 114 and the ratchet pawl 141 is disposed within the interior 126 of the second housing member 125. In other implementations, the ratchet teeth 139 are disposed within the interior 126 of the second housing member 125 and the ratchet pawl 141 is disposed on the spool 114.

Figure 7:
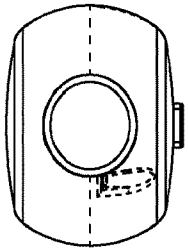
FIG. 7 is an opposite second end view of the jump rope of FIG. 1.
Figure 6:
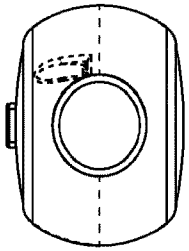
FIG. 6 is a first end view of the jump rope of FIG. 1.

In the example shown in FIGS. 5-7, the second end 131 of the spool 114 defines a recessed portion 138 into which a plurality of ratchet teeth 139 extend radially inwardly. A ratchet pawl mechanism 140 is disposed within the interior 126 of the second housing member 125. The ratchet pawl mechanism 140 includes a ratchet pawl 141 defining the hold member 116. The ratchet pawl 141 defines an opening 142 through which the spindle 128 of the second housing member 125 extends. The opening 142 is sized to enable movement of the ratchet pawl 141 relative to the spindle 128 at least along a slide axis $A_S$.

The ratchet pawl 141 (and hence the hold member 116) is movable (e.g., slidable) relative to the second housing member 125 between the hold position and the release position. When the ratchet pawl 141 is disposed in the hold position, the hold member 116 engages one of the ratchet teeth 139 of the spool 114. When the ratchet pawl 141 is disposed in the release position, the hold member 116 does not engage any of the ratchet teeth 139 (i.e., is radially spaced from the ratchet teeth 139).

The ratchet pawl 141 defines a spring support 143 at which a spring (e.g., a coil spring) 144 can be mounted. In certain implementations, the spring support 143 is located opposite the hold member 116. A spring stop 145 is disposed within the interior 126 of the second housing member 125. The spring 144 is held between the ratchet pawl 141 and the spring stop 145 to bias the ratchet pawl 141 in a first direction to the hold position.

The ratchet pawl 141 is operationally coupled to the release member 118. In certain implementations, the release member (e.g., a tab or flange) 118 extends outwardly from the ratchet pawl 141 through an aperture 146 defined in the second housing member 125. In an example, the release member 118 is monolithically formed with the ratchet pawl 141. In certain implementations, the aperture 146 is sized to enable movement of the release member 118 relative to the second housing member 125 along the slide axis $A_S$.

Accordingly, a user can access the release member 118 from an exterior of the storage chamber housing 111 and can press on the release member 118 to move the ratchet pawl 141 against the bias of the spring 144 to the release position. The spring 144 will bias the ratchet pawl 141 back to the hold position when the user releases the release member 118.

In certain implementations, each of the first and second housing members 120, 125 includes a latching finger 122, 127 that extends radially outwardly from the housing member. The latching fingers 122. 127 are inserted into an aperture 119*b* defined in the handlebar 119 to hold the storage chamber housing 111 to the handlebar 119. In some examples, the handlebar 119 is configured to rotate relative to the storage chamber housing 111. For example, the latching fingers 122, 127 are rotationally movable within the aperture 119*b*. In other examples, the handlebar 119 is rotationally fixed relative to the storage chamber housing 111. For example, the latching fingers 122, 127 can be attached to the handlebar 119 using adhesive.

In use, a user grasps a first handle arrangement 110A (FIG. 1) with a first hand and a second handle arrangement 110B (FIG. 1) in a second hand. The flexible, elongated member 102 joins the first and second handle arrangements 110A, 110B. The user steps on the stop member 105 disposed on the flexible elongated member 102. While stepping on the stop member 105, the user pulls at least one of the first and second handle arrangements 110A, 110B away from the stop member 105 to increase the length of the elongated member 102 extending between the first and second handle arrangements 110A, 110B.

For example, pulling on one or both of the handlebar arrangements 110A, 110B while maintaining the position of the stop member 105 applies sufficient force to the spool(s) 114 within the handle arrangement(s) 110A, 110B to counter-act the force applied by the respective retraction member 115. Accordingly, at least one of the sections 106, 107 of the elongated member 102 is dispensed through the respective ports 112 of the handle arrangements 110A, 110B. When a sufficient amount of the elongated member 102 has been dispensed from the handle arrangement(s) 110A, 110B, the user swings the flexible, elongated member 102 using the first and second handlebar arrangements 110A, 110B.

When finished, the user actuates a release member 118 of at least one of the handle arrangements 110A, 110B. For example, the user may depress a tab or flange 118 against a spring force to move the hold member 116 from the hold position to the release position. When the hold member 116 reaches the release position, the retraction member 115 automatically retracts the elongated member 102 into the storage chamber housing 111 (e.g., by winding the spool 114).

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A jump rope comprising:

an elongated flexible member extending from a first end to a second end;

a first storage chamber housing defining a first port through which the elongated flexible member extends so that the first end of the elongated flexible member is secured within an interior of the first storage chamber housing, the first storage chamber housing holding a first spool, a first retraction member, and a first hold member within the interior of the first storage chamber housing, the first spool defining a rotational axis, the first retraction member being configured to automatically wind at least a first portion of the elongated flexible member onto the first spool and the first hold member being configured to selectively inhibit the automatic winding by the first retraction member;

a first handlebar extending outwardly from the first storage chamber housing, the first handlebar defining a longitudinal axis that is transverse to the rotational axis of the first spool;

a second storage chamber housing defining a second port through which the elongated flexible member extends so that the second end of the elongated flexible member is secured within an interior of the second storage chamber housing, the second storage chamber housing holding a second spool, a second retraction member, and a second hold member within the interior of the second storage chamber housing, the second spool defining a rotational axis, the second retraction member being configured to automatically wind at least a second portion of the elongated flexible member onto the second spool and the second hold member being configured to selectively inhibit the automatic winding by the second retraction member; and a second handlebar extending outwardly from the second storage chamber housing, the second handlebar defining a longitudinal axis that is transverse to the rotational axis of the second spool.

2. The jump rope of claim 1, wherein the elongated flexible member extends through the first port of the first storage chamber housing without passing through the first handlebar.

3. The jump rope of claim 1, further comprising a stop member disposed at a fixed location on the elongated flexible member, the stop member being sized larger than the first and second ports.

4. The jump rope of claim 3, wherein the stop separates the elongated flexible member into a first length and a second length, wherein the interior of the first storage chamber housing is sized to hold the first length and the interior of the second storage chamber housing is sized to hold the second length.

5. The jump rope of claim 4, wherein the first length is the same as the second length.

6. The jump rope of claim 1, wherein the first storage chamber housing includes a first release member accessible from an exterior of the first storage chamber housing, the first release member being configured to move the first hold member from a respective hold position to a respective release position, thereby allowing the first retraction member to wind at least some of the first portion of the elongated flexible member on the first spool.

7. The jump rope of claim 6, wherein the second storage chamber housing includes a second release member, the second release member being configured to move the second hold member from a respective hold position to a respective release position, thereby allowing the second retraction member to wind at least some of the second portion of the elongated flexible member on the second spool.

8. The jump rope of claim 1, wherein the first retraction member includes a spring, wherein the first hold member includes a ratchet pawl biased towards ratchet teeth defined by the first storage chamber housing, and wherein the first release member is operationally coupled to the first hold member so that actuation of the first release member will disengage the ratchet pawl from the ratchet teeth.

9. The jump rope of claim 1, wherein the elongated flexible member includes a braided rope.

10. The jump rope of claim 1, wherein the elongated flexible member includes a solid rope.

11. The jump rope of claim 1, wherein the elongated flexible member includes a braided rope.

12. The jump rope of claim 1, wherein the elongated flexible member includes a solid rope.

13. A jump rope comprising:

an elongated flexible member extending from a first end to a second end;

a stop member disposed on the elongated flexible member at an intermediate location;

a first handle arrangement defining a first storage chamber sized to store a first length of the elongated flexible member, the first handle arrangement defining a port through which the first length is dispensed from and retracted into the first storage chamber, the first handle arrangement also including a first handlebar extending outwardly from the first storage chamber opposite from the respective port, the first handlebar defining an interior that is isolated from the first storage chamber;

a second handle arrangement defining a second storage chamber sized to store a second length of the elongated flexible member, the second handle arrangement defining a port through which the second length is dispensed from and retracted into the second storage chamber, the second handle arrangement also including a second handlebar extending outwardly from the second storage chamber opposite from the respective port, the second handlebar defining an interior that is isolated from the second storage chamber;

the first and second storage chambers being sized to cooperatively hold substantially the entire length of the elongated flexible member.

14. The jump rope of claim 13, wherein the elongated flexible member includes a first elongated flexible member and a second elongated flexible member that are both fixedly coupled to the stop member to form the elongated flexible member.

15. The jump rope of claim 13, wherein the first handle arrangement includes an automatic retraction mechanism configured to automatically wind the first length of the elongated flexible member.

16. The jump rope of claim 15, wherein the automatic retraction mechanism is actuated by movement of a release member disposed on the first handle arrangement.

17. The jump rope of claim 16, wherein the automatic retraction mechanism includes a spool biased to rotate in a first rotational direction and a blocking pawl configured to move between blocking and releasing positions, the blocking pawl retaining the spool against rotating in the first rotational direction when in the blocking position, the blocking pawl releasing the spool to rotate in the first rotational direction when in the releasing position.

18. The jump rope of claim 17, wherein the block pawl is moved between the blocking position and the release position by sliding the release member.

19. The jump rope of claim 17, wherein the block pawl is moved between the blocking position and the release position by depressing the release member.

* * * * *